US007572965B2

(12) United States Patent
Ledgar

(10) Patent No.: US 7,572,965 B2
(45) Date of Patent: Aug. 11, 2009

(54) PERCUSSION INSTRUMENT

(76) Inventor: Matthew Ledgar, P.O. Box 102, Repton, 2454 NSW (AU)

( * ) Notice: Subject to any disclaimer, the term of this patent is extended or adjusted under 35 U.S.C. 154(b) by 647 days.

(21) Appl. No.: 10/556,264

(22) PCT Filed: May 12, 2004

(86) PCT No.: PCT/AU2004/000616

§ 371 (c)(1),
(2), (4) Date: Nov. 14, 2005

(87) PCT Pub. No.: WO2004/100124

PCT Pub. Date: Nov. 18, 2004

(65) Prior Publication Data

US 2007/0028747 A1 Feb. 8, 2007

(30) Foreign Application Priority Data

May 12, 2003 (AU) ..... 2003902262

(51) Int. Cl.
*G10D 13/08* (2006.01)

(52) U.S. Cl. ..... 84/402; 446/422

(58) Field of Classification Search ..... 84/402, 84/403, 404; 446/422
See application file for complete search history.

(56) References Cited

U.S. PATENT DOCUMENTS 976,718 A * 11/1910 Bartholomae ..... 446/422
4,127,053 A * 11/1978 Cohen ..... 84/402

* cited by examiner

*Primary Examiner*—Jeffrey Donels
*Assistant Examiner*—Jianchun Qin
(74) *Attorney, Agent, or Firm*—Patwrite LLC; Mark David Torche

(57) ABSTRACT

A compound percussion instrument comprises a first percussive instrument, such as a tambourine (1). The tambourine (1) has a frame (2) having a rim (3). A plurality of jingles (6) is mounted to the rim (3). A second percussive instrument includes a hammer and an anvil. The hammer or anvil may be a temple block (7) and the other of the hammer or anvil may be a fixed or movable striker (11, 14). A trigger (13) is mounted to a handle (5) of the tambourine (1). Actuation of the trigger (13) causes the hammer to strike the anvil to sound a musical note from the second percussive instrument. The compound percussion instrument may be played with a single hand and allows two different musical sounds to be obtained.

18 Claims, 5 Drawing Sheets

PERCUSSION INSTRUMENT

CROSS REFERENCE TO RELATED APPLICATIONS

This Application is a United States National Stage entry from International Patent Application Ser. No. PCT/AU2004/000616, filed May 5, 2004.

FIELD OF THE INVENTION

The present invention relates to a percussion instrument. In particular the present invention relates to a percussion instrument that maybe operable to produce compound sounds without requiring the musician to employ an additional hand to operate a secondary percussive instrument or to suspend operation of a primary percussive instrument so as to operate the secondary percussive instrument.

BACKGROUND TO THE INVENTION

Musicians utilise percussion instruments to establish beat. In many styles of music musicians use a number of types of percussion instruments to establish complex structures to the beat. In order to employ a number of types of percussion instruments it is generally necessary to utilise a number of musicians or arrange the music in a manner in which the operation of multiple percussion instruments are staggered. A limited number of percussion instruments allow more than one type sound to be produced. These types of percussion instruments require the use of complex actions to generate multiple types of percussive sounds. Either the musician must use an additional hand or must interrupt the playing of the first instrument in order to produce a second percussive sound.

The use of a number of musicians to play percussion instruments is generally impractical. Bands of musicians that perform are limited in size for economic and logistic factors. In order for a band of musicians to be economically viable it is necessary for their numbers to be limited. Further, the coordination of a large number of musicians is logistically complex and, from a musical timing point of view, difficult to control. Accordingly, it is desirable to maximise the usage of the musicians by enabling the musicians to produce a greater number of sounds.

There have previously been produced a variety of compound instruments that are unable to the production of a plurality of sounds types. For example, musicians often utilise a guitar not only as a stringed instrument but also as a percussion instrument by striking of the hollow body of the guitar. This type of use of a guitar takes advantage of the hollow body of the guitar rather than use a second type of instrument. In a drum kit a multiplicity of percussion instruments are provided. There may be a variety of different drum types as well as cymbals that maybe struck by the drummer. Whilst the drummer may play one or more drums, in order to play the cymbals the drummer either has to strike the cymbals with a drumstick in the inactive hand or interrupt playing the drums.

BRIEF DESCRIPTION OF THE INVENTION

The present inventor has now developed a compound percussion instrument that enables a musician to operate simultaneously two percussive instruments without having to utilise an additional hand. According to the present invention there is provided a compound percussion instrument comprising a first percussive instrument and a second percussive instrument wherein the first percussive instrument is operable by a player using at least one hand and wherein the second percussive instrument is simultaneously operable by a player using said at least one hand wherein said second percussive instrument comprises a hammer, at least one anvil and an actuator wherein the actuator is disposed on the first percussive instrument and operates the hammer and causes the hammer to strike the anvil.

Preferably, the first percussive instrument has a handle and the actuator is disposed on the handle of the first percussive instrument.

In some embodiments, the percussion may include a plurality of hammers actuated by the actuator.

The compound percussion instrument of the present invention advantageously may be played such that both the first and second percussive instruments may be played independently or in concert whereby notes may be played on the first and second percussive instruments simultaneously. The compound percussion instrument allows a musician to add an additional instrument to a musical composition without having to introduce additional musicians, but more importantly to augment an instrument with a readily operable secondary instrument so as to create a new sound or sounds.

The first percussive instrument may be any desired percussive instrument. For example, the first percussive instrument may be a tambourine, shaker, rattle, bells or the like.

In a preferred embodiment of the present invention the first percussive instrument is a tambourine. The tambourine preferably includes a rim on which a plurality of jingles, metal disks or bells, are mounted. Typically a tambourine will have two rows of jingles disposed around the rim. It is preferred that the tambourine of the first embodiment of the present invention includes three rows of jingles disposed around the rim. Tambourines typically include a portion of the rim that is free of jingles that provides a handle for the musician. Preferably the handle may be shaped to conform to the hand of the musician. Tambourines are typically operated by a rhythmical shaking action of the wrist. The rhythmical shaking action of the wrist is a continuous action that maybe interrupted by striking the tambourine against the musician's body. This type of action generally precludes the musician operating a second instrument with the same hand simultaneously.

Other percussive instruments may be used as the first percussive instrument. It will be apparent to those skilled in the art that percussive instruments that are operable with a single hand may advantageously incorporate a second percussive instrument of the type described herein. Such percussive instruments are generally operated by the musicians simultaneously with other instruments, such as keyboards or a microphone.

The second percussive instrument comprises a hammer, at least one anvil and an actuator wherein the actuator operates the hammer and causes the hammer to strike the anvil. The hammer maybe formed in any convenient configuration. The hammer is mounted to strike the anvil. The hammer may be pivotally mounted on the compound percussion instrument such that the hammer may pivot to strike the anvil. In another configuration, the hammer may be slidably mounted on the compound percussion instrument or in another manner that permits the hammer to strike the anvil.

In a preferred configuration the hammer may be biased to a primed condition. The hammer may be biased using a spring, of the coiled or leaf type, or using an over centre pivotal mount. It is preferred that the hammer be biased to a primed condition with an over centre pivotal mount having opposed anvils on either side of the pivot point. The hammer is preferably biased using a coil springs such that in a primed condition of the hammer rests against one of the anvils.

In another embodiment, the compound percussion instrument includes a single anvil and the hammer is biased to a primed position in which a striking surface of the hammer is spaced from the anvil.

In one form of the invention the hammer maybe chosen to provide the desired acoustic response. In this embodiment, it is preferred that the hammer be in the form of a temple block. A temple block is a hollow member having at least one opening. Sound produced by striking the temple block against the anvil resonates within the temple block and is emitted therefrom.

In another embodiment, the at least one anvil may be chosen to provide the desired acoustic response.

Either the at least one anvil or the hammer, or both, may provide the desired acoustic response. Generally it is preferred that either the at least one anvil or the hammer provide the desired acoustic response. For example, where the hammer is chosen to provide the desired acoustic response the at least one anvil may be a rigid member that has little or no acoustic response. Alternatively, where the hammer is a relatively rigid member having little or no acoustic response the at least one anvil is preferably adapted to provide the desired acoustic response.

In a one configuration the hammer is in the form of a temple block that strikes opposed anvils on either side of a pivotal mount. The opposed anvils may be in the form of projections extending from the frame of the compound percussion instrument.

The hammer is actuated by an actuator that causes the hammer to strike the anvil. The actuator is preferably associated with the handle of the compound percussion instrument such that the musician may operate the actuator whilst holding the compound percussion instrument in a manner suited for the playing of the first percussive instrument. The actuator may be directly connected to the hammer and form an extension therefrom. It is preferred that the actuator is indirectly connected to the hammer via a linkage. The linkage may be a chain, a cord, a bar or a member.

The actuator is preferably in the form of a trigger.

In a preferred form, the temple block is a slit drum having a tear dropped shape cross section. Preferably the slit will run from an aperture in each end wall of the slit drum along the midline of the slit drum. The temple block or slit drum may be fixedly mounted at its sharp end to the frame of the instrument or it may be hingedly mounted at its sharp end to the frame of the instrument in a preferred configuration.

BRIEF DESCRIPTION OF THE DRAWINGS

The present invention will now be described with reference to the accompanying drawings. It will be understood that the accompanying drawings and associated description provided for illustrative purposes.

DETAILED DESCRIPTION OF THE DRAWINGS

Figure 1:
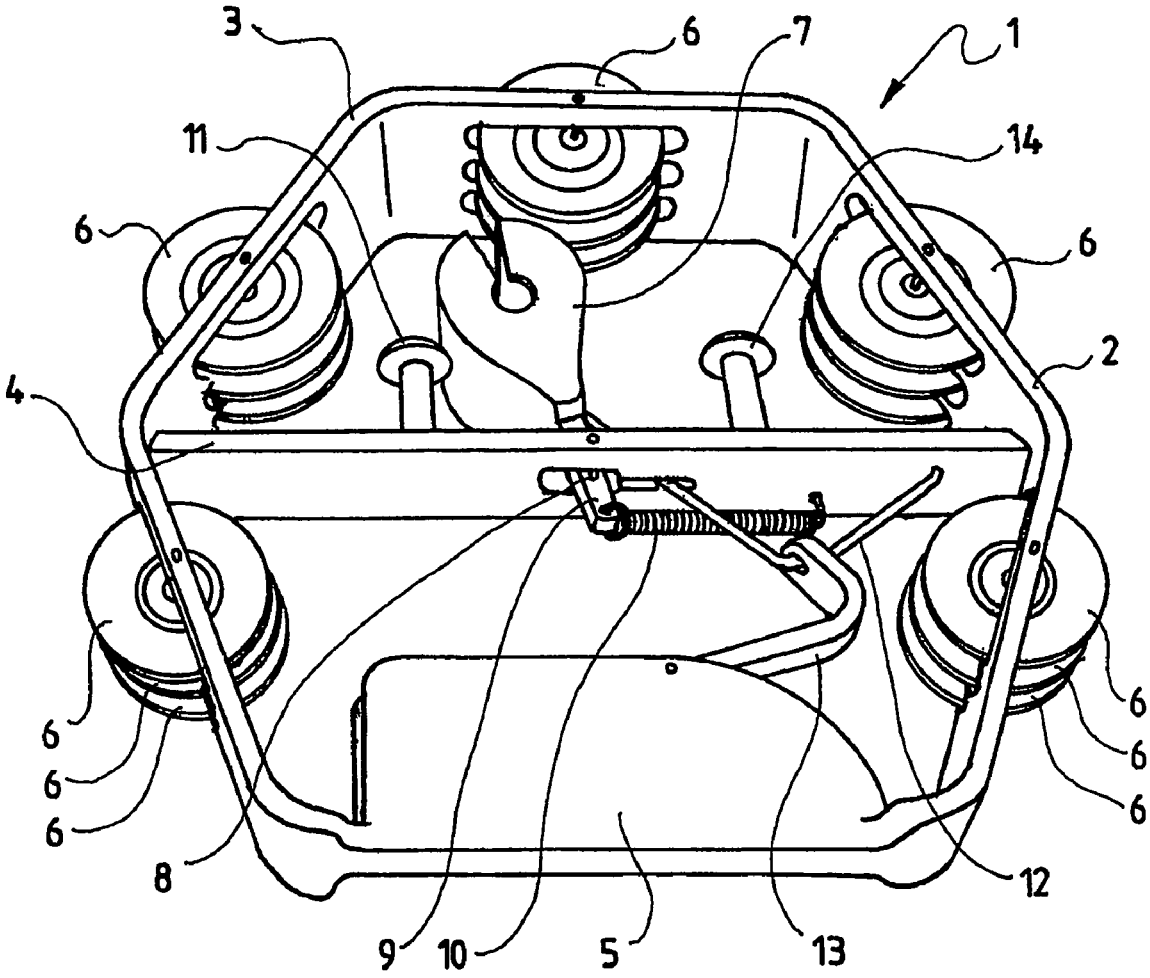
FIG. 1 shows a perspective view of a compound percussion instrument according to one embodiment of the present invention.

It will be appreciated that the drawings accompanying this specification have been provided to show preferred embodiments of the present invention. Accordingly, it will be understood that the drawings are illustrative of the present invention and that the invention should not be considered to be limited to all features shown in the drawings.

A tambourine 1 is shown in FIG. 1. The tambourine 1 is formed from a frame 2. The frame 2 includes a rim 3 and a brace 4. A handle 5 is mounted on the rim 3.

The rim 3 supports a plurality of jingles 6 mounted in the three rows and was placed around the rim 3. A musician is able to play the tambourine 1 by holding the handle 5 and shaking the tambourine 1 causing the jingles 6 to jangle.

The brace 4 extends diametrically within the rim 3. A hammer, in the form of a temple block 7, is mounted on the brace 4. A pivotal mount 8 extends through the brace 4 and an extension 9 of the temple block 7 is attached to a compression spring 10. The compression spring 10 is fixed to the brace 4. The compression spring 10 holds the temple block 7 against the first anvil 11. A cord 12 is attached to the temple block 7 above the pivotal mount 8. The cord 12 is also attached to the brace 4. A trigger 13 is pivotally connected to the handle 5 and the cord passes through the remote end of the trigger 13. The musician may call the trigger 13 to rotate the temple block 7 such that it strikes the second anvil 14. By releasing the trigger 13 the compression spring 10 returns of the temple block 7 such that it strikes of the first anvil 11.

Figure 2:
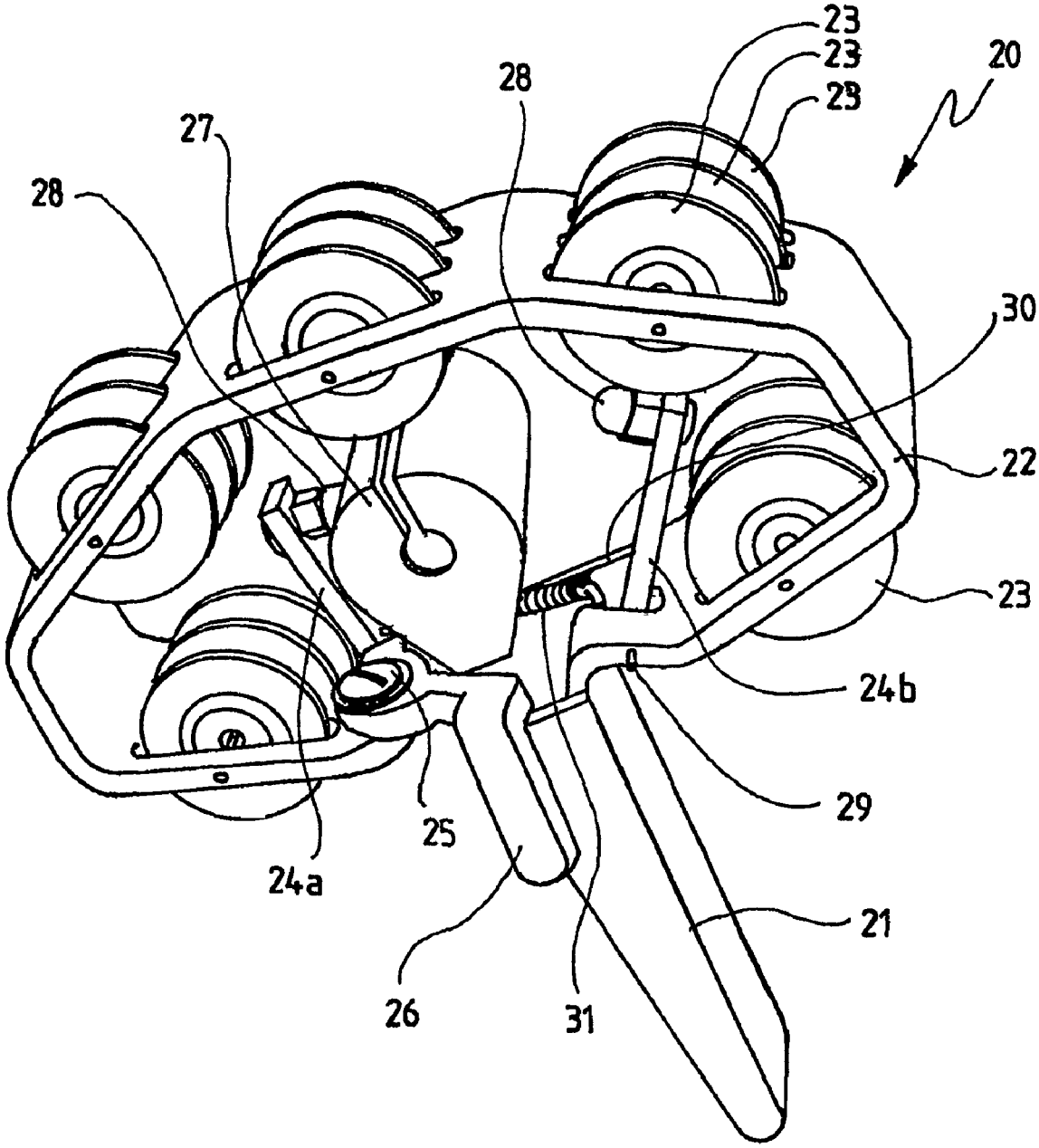
FIG. 2 shows a perspective view of a compound percussion instrument according to a second embodiment of the present invention.

FIG. 2 shows a tambourine 20 having a frame 22 mounted on a handle 21. The frame 22 has five sets of jingles 23 disposed around the frame 22. The jingles are mounted to jangle by the musician shaking the frame.

An anvil, in the form of a temple block 27, is fixedly mounted to the frame 22 above the handle 21. A pair of opposed hammers 28 are mounted on respective arms 24. The respective arms 24 are interconnected by a cord 30. The respective arms 24 are biased with a spring 31. A lever 26 is pivotally mounted on the frame 22 by a pivot mount 25 in the form of a bolt. The trigger 26 is connected to the arm 24*a* such that on depression of the trigger 26 arm 24*a* pivots away from the temple block 27 and arm 24*b* moves towards the temple block 27 and causes the hammer 28 mounted on arm 24*b* to strike the temple block.

Figure 3:
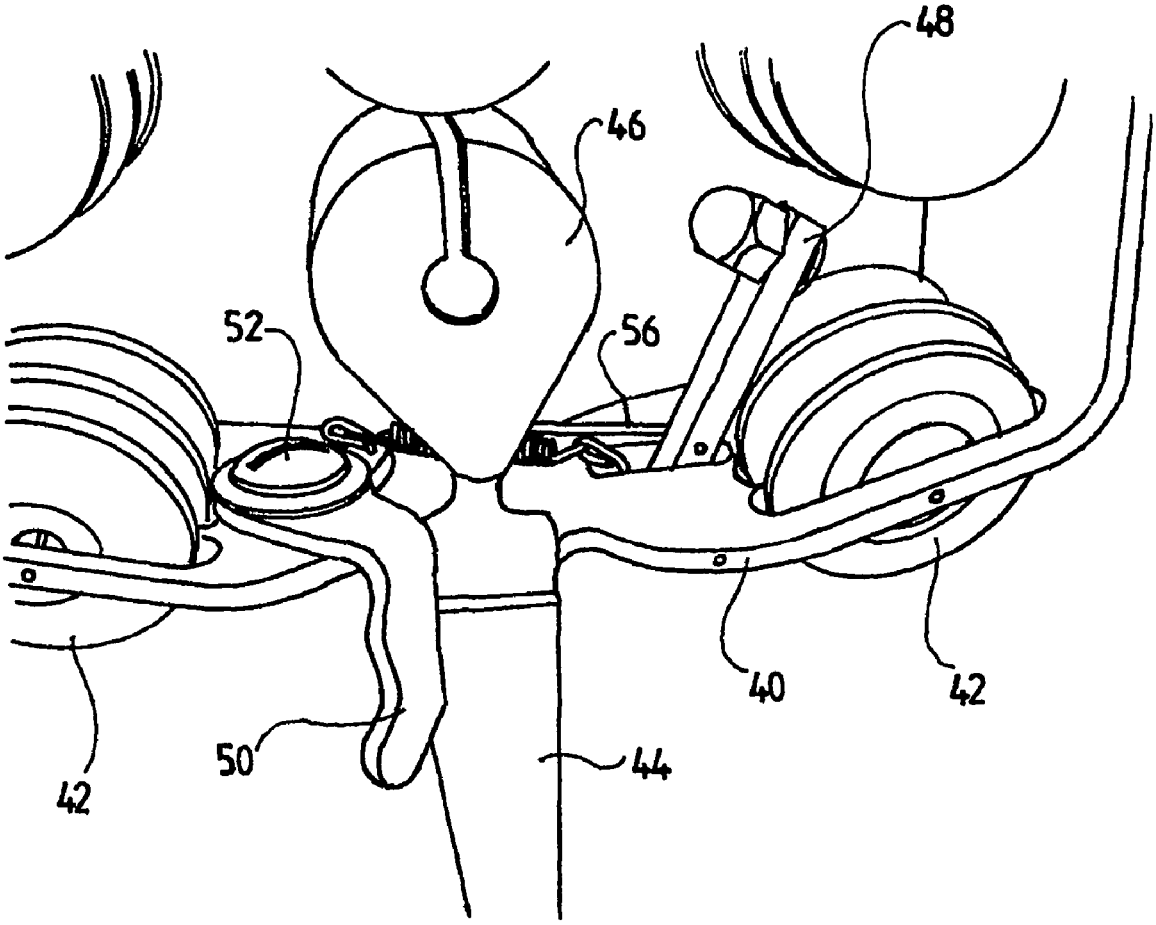
FIG. 3 shows a front view of part of a tambourine in accordance with a further embodiment of the present invention.
Figure 4:
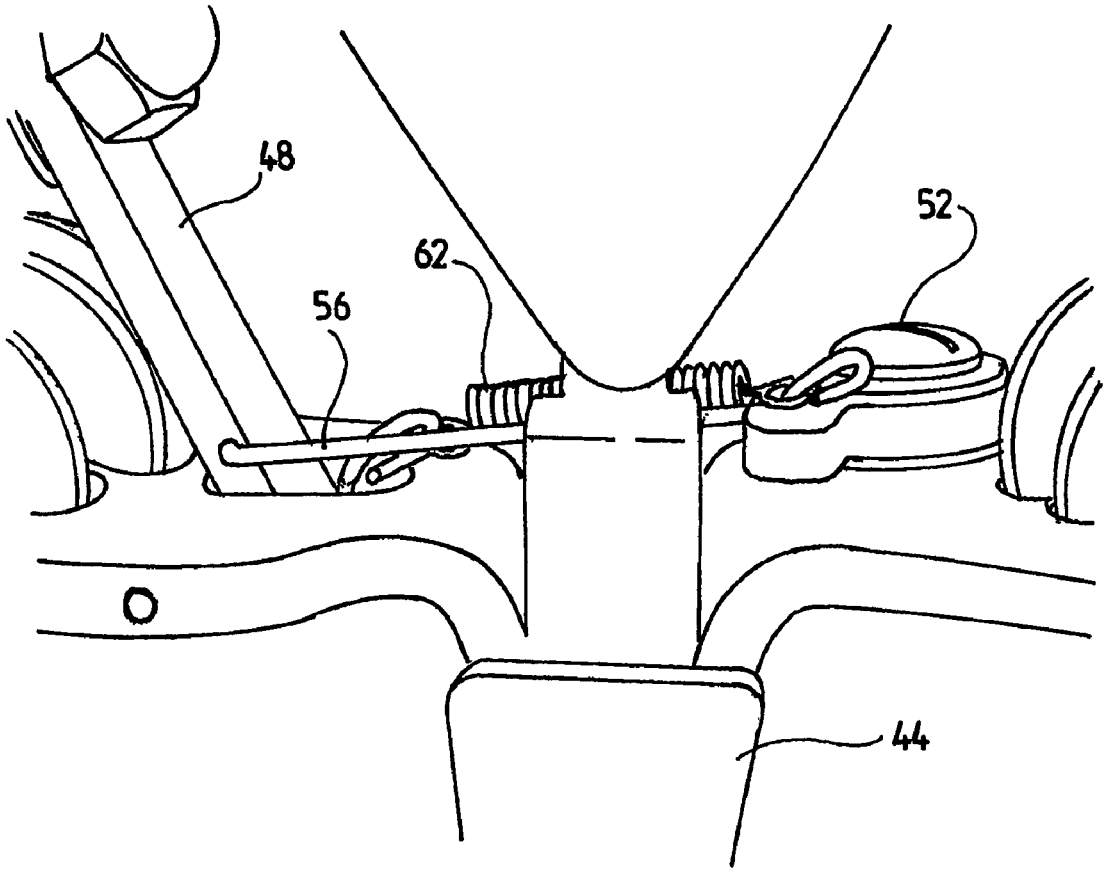
FIG. 4 shows a rear view of FIG. 3.
Figure 5:
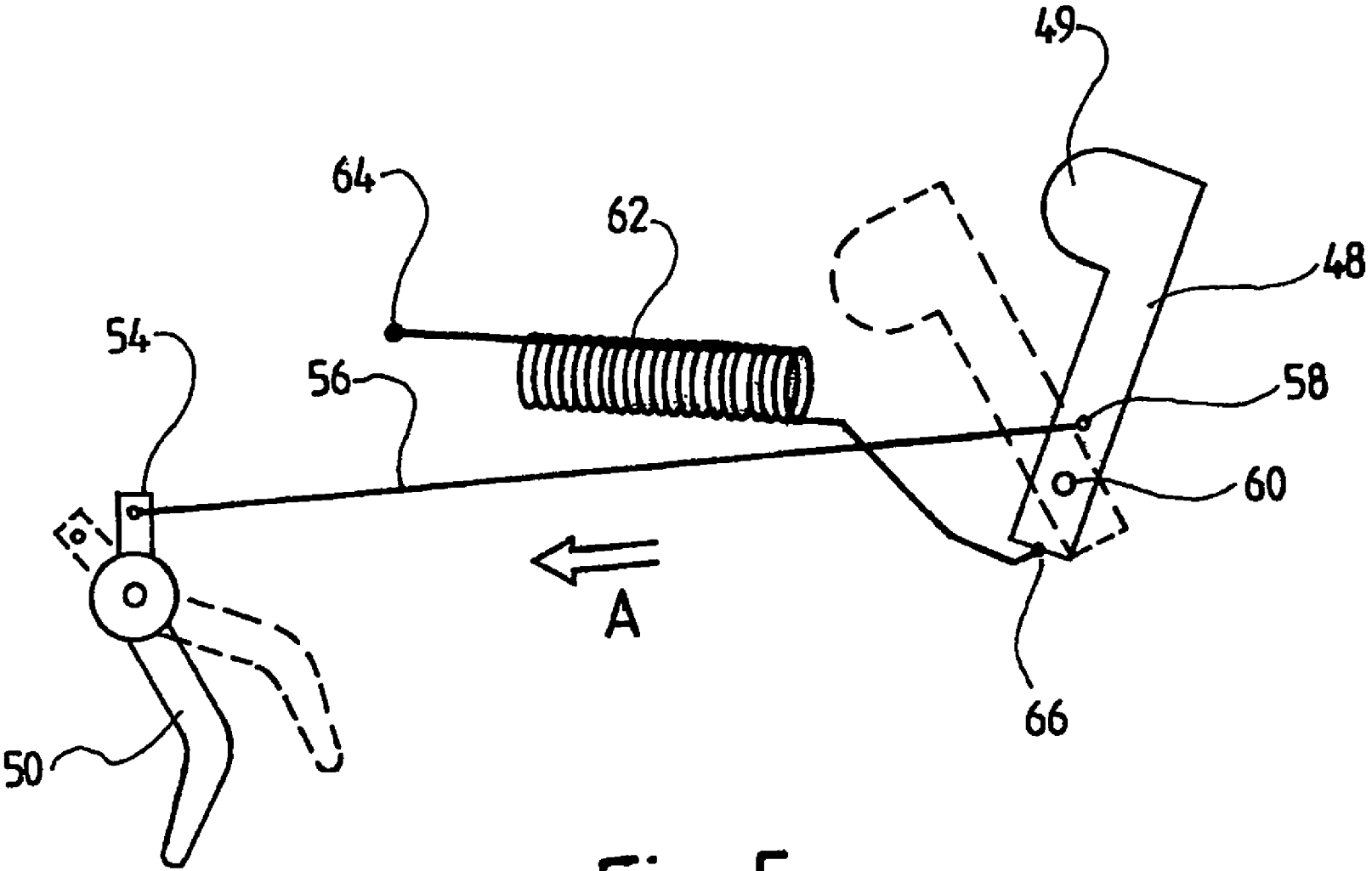
FIG. 5 is a schematic diagram showing the actuating mechanism for operating the hammer of the tambourine shown in FIGS. 3 and 4.

The tambourine shown in FIGS. 3 to 5 comprises a rim 40 having a plurality of jingles 42 mounted thereto. A handle 44 depends from the rim 40 and allows a musician to hold the tambourine for use.

The tambourine further includes an anvil in the form of a temple block 46 fixedly mounted to the rim 40. A hammer 48 is arranged to strike the temple block 46. In order to actuate the hammer 48, a trigger 50 is pivotally mounted at pivot mount 52 on the rim 40. Trigger 50 has a radially extending arm 54 extending outwardly therefrom. Solid linkage 56 interconnects the arm 54 of the trigger 50 to hammer 48. As schematically shown in FIG. 5, the solid linkage 56 is pivotally connected at point 58 to trigger 50. Point 58 is located above pivot point 60 at which the hammer is pivotally mounted to the rim 40 of the tambourine.

A tension spring 62 is mounted at one end 64 to the rim 40. The other end of the tension spring 62 is mounted at point 66 to the lower end of hammer 48. As can be best seen in FIG. 5, point 66 is located below pivot point 60 at which the hammer 48 is mounted to the rim 40. As a result, the tension spring 62 biases the hammer 48 in a primed position in which the striker 49 of the hammer 48 is positioned away from the temple block 46. This position is shown in solid outline in FIG. 5.

In use, the musician can actuate the hammer by pressing the trigger 50 to cause it to rotate about pivot mount 52 and adopt the position shown in broken outline in FIG. 5. This causes solid linkage 56 to move in the direction of arrow A which causes the hammer 48 to pivot about point 60 and move to apposition shown in broken outline in FIG. 5. In this position, the hammer 48 strikes the temple block 46. Spring 62 is stretched such that when the musician releases the trigger 48 the spring 62 moves the hammer 48 back to the primed position shown in solid outline in FIG. 5. This also resets the trigger 50 to the position shown in solid outline in FIG. 5.

It will be appreciated by those skilled in the art that variations and modifications to the invention described herein will be apparent without departing from the spirit and scope of thereof. In particular, there are a number of alternative actuating mechanisms for causing the hammer to strike the anvil that may be used in the present invention. The actuators shown in the embodiments of FIGS. 1 to 5 include a trigger and this is preferred for ease and convenience of use by the musician. Persons skilled in the art will appreciate that the invention described above may be subject to improvements and modifications that will be apparent without departing from the spirit and scope of the invention described herein.

The invention claimed is:

1. A compound percussion instrument comprising:

a first percussive instrument;

a second percussive instrument wherein the first percussive instrument is operable by a player using at least one hand and wherein the second percussive instrument is simultaneously operable by a player using said at least one hand wherein said second percussive instrument comprises a hammer;

at least one anvil;

said hammer being slidably mounted on said compound percussion instrument to permit said hammer to strike said anvil; and an actuator wherein the actuator is disposed on the first percussive instrument and operates the hammer and causes the hammer to strike the anvil.

2. A compound percussion instrument as claimed in claim 1 wherein the first percussive instrument has a handle and the actuator is disposed on the handle of the first percussive instrument.

3. A compound percussion instrument as claimed in claim 1 wherein the first percussive instrument comprises at least one of a tambourine, shaker, rattle, and bell.

4. A compound percussion instrument as claimed in claim 1 wherein the hammer is pivotally mounted on the compound percussion instrument such that the hammer is pivotally mounted to strike the anvil.

5. A compound percussion instrument as claimed in claim 1 wherein the hammer is biased to a primed condition.

6. A compound percussion instrument as claimed in claim 5 wherein the hammer is biased using a spring.

7. A compound percussion instrument as claimed in claim 6 wherein the hammer is biased to a primed condition with an over centre pivotal mount having opposed anvils on either side of the pivot point.

8. A compound percussion instrument as claimed in claim 7 wherein the hammer is biased using a spring such that in a primed condition the hammer rests against one of the anvils.

9. A compound percussion instrument as claimed in claim 6 wherein the compound percussion instrument includes a single anvil and the hammer is biased to a primed position in which a striking surface of the hammer is spaced from the anvil.

10. A compound percussion instrument as claimed in claim 1 wherein the hammer is chosen to provide a desired acoustic response.

11. A compound percussion instrument as claimed in claim 10 wherein the hammer is in the form of a temple block comprising a hollow member having at least one opening.

12. A compound percussion instrument as claimed in claim 11 wherein the hammer is in the form of a temple block that strikes opposed anvils on either side of a pivotal mount.

13. A compound percussion instrument as claimed in claim 12 wherein the opposed anvils are in the form of projections extending from a frame of the compound percussion instrument.

14. A compound percussion instrument as claimed in claim 13 wherein the at least one anvil is chosen to provide the desired acoustic response.

15. A compound percussion instrument as claimed in claim 1 further comprising an actuator directly connected to the hammer and forms an extension therefrom.

16. A compound percussion instrument as claimed in claim 15 wherein the actuator is indirectly connected to the hammer via a linkage.

17. A compound percussion instrument as claimed in claim 15 wherein the actuator is a trigger.

18. A compound percussion instrument as claimed in claim 15 wherein the percussion instrument includes a plurality of hammers actuated by the actuator.

* * * * *